US007688338B2

(12) United States Patent
Kao et al.

(10) Patent No.: US 7,688,338 B2
(45) Date of Patent: Mar. 30, 2010

(54) APPARATUS AND METHOD FOR ADJUSTING BRIGHTNESS

(75) Inventors: Hsu-Chia Kao, Pingjen (TW); Tsan-Hung Tsai, Sanchung (TW); Yu-Wen Huang, Sanchung (TW)

(73) Assignee: Quanta Computer Inc., Tao Yuan Shien (TW)

( * ) Notice: Subject to any disclaimer, the term of this patent is extended or adjusted under 35 U.S.C. 154(b) by 957 days.

(21) Appl. No.: 11/199,944

(22) Filed: Aug. 8, 2005

(65) Prior Publication Data

US 2006/0221100 A1 Oct. 5, 2006

(30) Foreign Application Priority Data

Mar. 30, 2005 (TW) ..... 94110129 A

(51) Int. Cl.
*G09G 5/10* (2006.01)
*G09G 3/36* (2006.01)

(52) U.S. Cl. ..... 345/690; 345/89

(58) Field of Classification Search ..... 345/690, 345/87–107, 77, 58
See application file for complete search history.

(56) References Cited

U.S. PATENT DOCUMENTS 6,778,160 B2 * 8/2004 Kubota et al. ..... 345/690
7,170,477 B2 * 1/2007 Okamoto et al. ..... 345/77
2001/0024181 A1 * 9/2001 Kubota et al. ..... 345/87
2001/0035850 A1 * 11/2001 Okamoto et al. ..... 345/77
2004/0036703 A1 * 2/2004 Aoki et al. ..... 345/690
2004/0155855 A1 * 8/2004 Chang ..... 345/102
2005/0140631 A1 * 6/2005 Oh et al. ..... 345/89
2005/0162343 A1 * 7/2005 Kim ..... 345/58

* cited by examiner

*Primary Examiner*—Chanh Nguyen
*Assistant Examiner*—Adam J Snyder
(74) *Attorney, Agent, or Firm*—Stites & Harbison PLLC; Juan Carlos A. Marquez, Esq.

(57) ABSTRACT

The invention discloses an apparatus for adjusting the brightness of the $i^{th}$ image of an inputted image sequence in a display system. The image sequence includes a plurality of images which each consists of a plurality of pixels. The apparatus includes a first calculating module for calculating a current brightness ratio, a second calculating module for calculating an averaged brightness ratio, a judging module for outputting one selected from the current brightness ratio or the averaged brightness ratio as an outputted brightness ratio, a determining module for storing a plurality of brightness ratios and the corresponding gains and for determining the gain corresponding to the outputted brightness ratio, and an adjusting module for multiplying the gray scale level of each pixel of the $i^{th}$ image by the gain corresponding to the outputted brightness ratio respectively, so as to adjust the brightness of the $i^{th}$ image.

22 Claims, 9 Drawing Sheets

APPARATUS AND METHOD FOR ADJUSTING BRIGHTNESS

BACKGROUND OF THE INVENTION

1. Field of the Invention

The invention relates to an apparatus and the method thereof applied in a display system for adjusting the brightness of an inputted video sequence, and more particularly the apparatus of the invention is suitable for all kinds of color spaces.

2. Description of the Prior Art

Flat panel display will be the most popular display in the future, and more particularly people pay much more attention on liquid crystal display (LCD) due to the advantages including thinner thickness, lighter weight, lower radiation, higher resolution, higher brightness, and so on. Furthermore, LCD can be applied to various applications, e.g. personal computer (PC), commercial billboard, home theater, and so on.

The brightness of a conventional LCD is generated via a back light module, and the permeability of the back light module can be changed by the liquid crystal, so as to decide the brightness (luminance or gray scale level) of an image. When an 8 bit LCD is used to display images, an image has the highest brightness as the gray scale level of the image is 255, and another image has the lowest brightness as the gray scale level of the image is 0. Currently, the brightness of an LCD TV ranges between 400 cd/$m^2$ and 600 cd/$m^2$ as the gray scale level is 255 and between 0.7 cd/$m^2$ and 1.4 cd/$m^2$ as the gray scale level is 0. A pupil of the eye will automatically enlarge and shrink with the environmental brightness to control the amount of light getting into the eye. When a big area of an image is displayed with high gray levels (e.g. snow scene), the pupil will automatically shrink to reduce the amount of light getting into the eye. When a big area of an image is displayed with low gray levels (e.g. night scene), the pupil will automatically enlarge to increase the amount of light getting into the eye. In practical application, a TV program is always displayed with bright and dark image alternately, so the pupil will also enlarge and shrink at every moment when the displayed image is changed. Thus, when a user watches programs for a long time, he/she will feel tired easily due to the characteristic of high brightness of the LCD.

Referring to FIG. 1A and FIG. 1B, FIG. 1A is a diagram illustrating the relation between the brightness and the brightness ratio based on a CRT TV and an LCD TV. FIG. 1B is a diagram illustrating the relation between the lumen and the brightness ratio based on the CRT TV and the LCD TV. As shown in FIG. 1A, the product of the brightness and the brightness ratio represents the lumen outputted by the TV. As shown in FIG. 1B, when the brightness ratio is higher than a specific value, the lumen of the CRT TV will approach a constant. Accordingly, compared to the LCD TV, when a user uses the CRT TV to watch programs, the pupil of the user will not enlarge and shrink excessively, so that the user will not feel tired easily.

Moreover, when a user uses the LCD TV to watch programs for a long time, it not only causes the eye of the user heavy load but also easily causes the image bad contrast. The reason is that the pupil needs a span of time to enlarge and shrink. When the amount of light getting into the eye cannot be controlled effectively, the contrast of the image will be worse.

Therefore, the objective of the invention is to provide an apparatus and the method thereof for adjusting the brightness of an inputted video sequence, so as to solve the above-mentioned problems.

SUMMARY OF THE INVENTION

An objective of the invention is to provide an apparatus and the method thereof or automatically controlling the lumen of a display system with the changed image, so as to reduce the load for the eye when a user watches programs for a long time and to improve the contrast of the image.

According to a preferred embodiment of the invention, a video sequence is inputted into a display system. The inputted video sequence includes N image frames to be displayed. Each of the N image frames consists of T pixels, and each pixel of each image frame includes M color components and M gray scale levels. Each of the M gray scale levels corresponds to one of the M color components, and N, T, and M are respectively a natural number. In this embodiment, the M color components are respectively R, G, and B (Red, Green, and Blue) color components conforming to RGB color space. In RGB color space, the brightness and the color are mixed and cannot be separated from the R, G, and B color components. Accordingly, the apparatus of the invention is used for adjusting the gray scale levels of each pixel of the image frame in the video sequence, so as to adjust the brightness of the image frame.

The apparatus of the invention functions adjusting the M gray scale levels of the M color components of the ith image frame in the video sequence, and i is an integer index ranging from 1 to N. The gray scale levels of the image frames previous to the ith image frame have been adjusted, and each of the image frames previous to the ith image frame has a respective brightness ratio. Each brightness ratio is determined based on the gray scale levels of the corresponding image frame and is within an allowable range. A plurality of gains is previously provided. Each of the gains corresponds to one of the brightness ratios and varies within the allowable range.

According to the invention, the apparatus for adjusting the gray scale levels includes a first calculating module, a second calculating module, a judging module, a determining module, and an adjusting module. The first calculating module is used for retrieving all of the gray scale levels of all pixels of the ith image frame, and calculating, according to all of the gray scale levels of all pixels of the ith image frame, a current brightness ratio. The second calculating module is used for calculating, according to all of the brightness ratios of the image frames previous to the ith image frame and the current brightness ratio, an averaged brightness ratio. The judging module is used for receiving the current brightness ratio and the averaged brightness ratio, and outputting one selected from the current brightness ratio or the averaged brightness ratio as an outputted brightness ratio, wherein the outputted brightness ratio is also within the allowable range. The determining module is used for storing the brightness ratios varying within the allowable range and the corresponding gains. The determining module has an input coupled to receive the outputted brightness ratio and determines the gain corresponding to the outputted brightness ratio. The adjusting module is used for receiving the gain corresponding to the outputted brightness ratio and for multiplying the gray scale level of each color component of the ith image frame by the gain corresponding to the outputted brightness ratio, respectively.

Therefore, when the display system displays a program, the apparatus of the invention can prevent the image brightness from changing violently, so as to reduce the load for the eye when a user watches the program for a long time and to improve the contrast of the image.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1A:
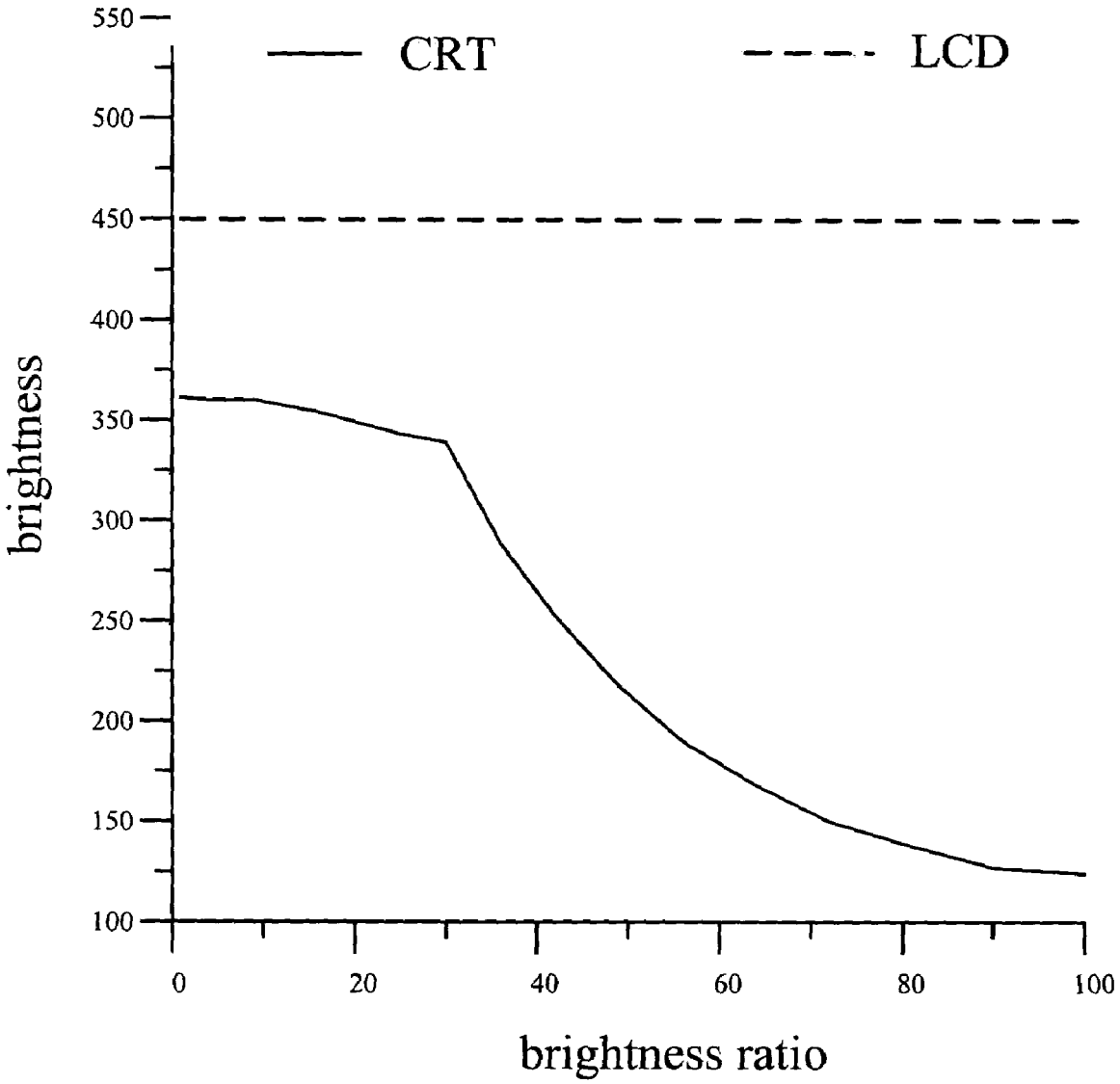
FIG. 1A (prior art)
FIG. 1A is a diagram illustrating the relation between the brightness and the brightness ratio based on a CRT TV and an LCD TV.
Figure 1B:
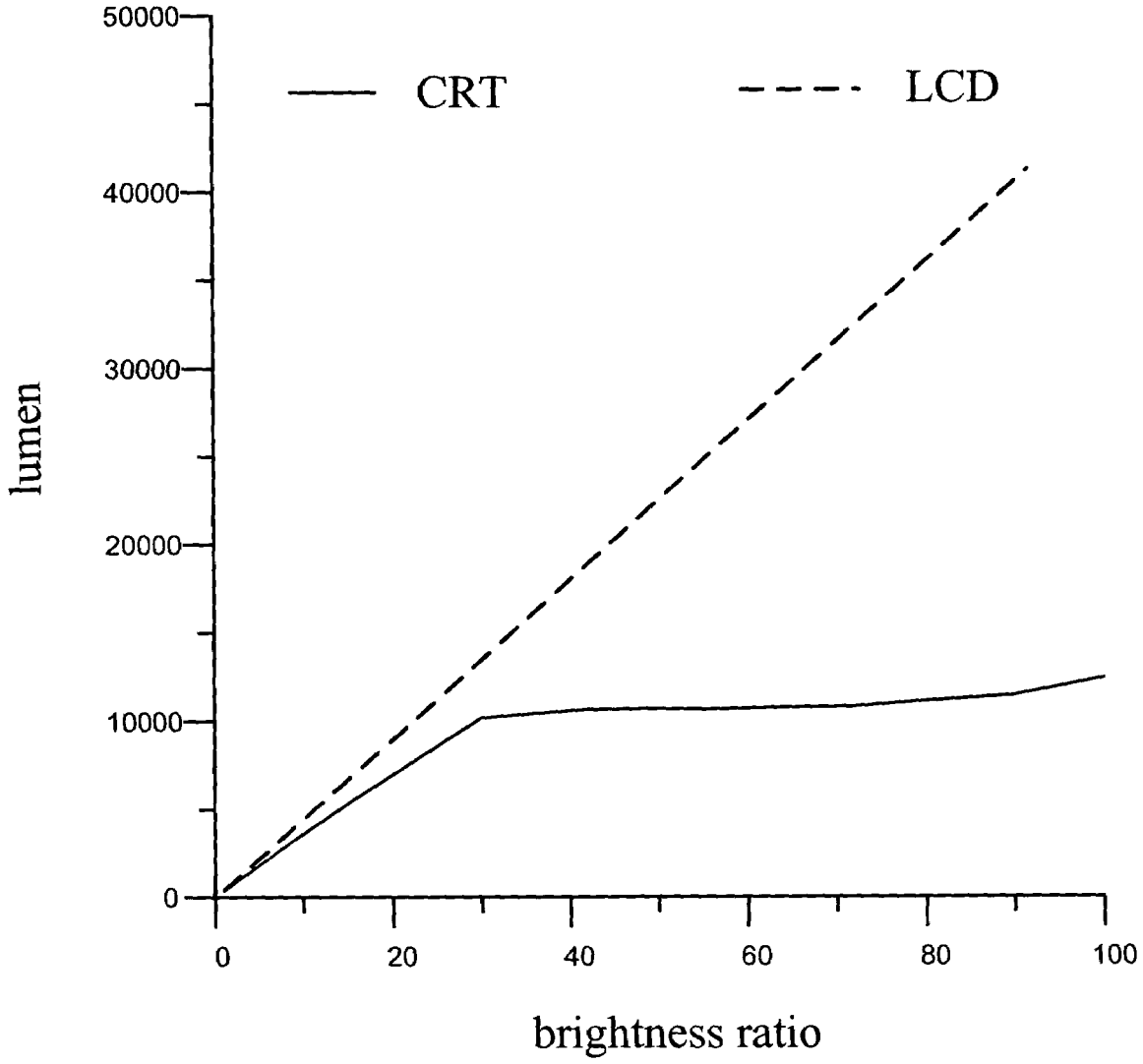
FIG. 1B (prior art)
FIG. 1B is a diagram illustrating the relation between the lumen and the brightness ratio based on the CRT TV and the LCD TV.

The invention discloses an apparatus and the method thereof for adjusting the brightness of an inputted video sequence in a display system. No matter the inputted video sequence conforms to which color space, the apparatus and the method of the invention are always suitable. For example, when an image frame conforms to RGB color space, the invention is to adjust the gray scale levels of the R, G, and B color components because the brightness and the color are mixed and cannot be separated from the R, G, and B color components, so as to control the brightness of the image frame. When an image frame conforms to L*a*b* color space, the invention is to adjust the luminance of the luminance component L* because each pixel of the image frame is converted to include two color components a* and b* and a luminance component L*, so as to control the brightness of the image frame.

According to a first preferred embodiment of the invention, a video sequence is inputted into a display system. The inputted video sequence includes N image frames to be displayed. Each of the N image frames consists of T pixels, and each pixel of each image frame includes M color components and M gray scale levels. Each of the M gray scale levels corresponds to one of the M color components, and N, T, and M are respectively a natural number. In this embodiment, the M color components are respectively R, G, and B (Red, Green, and Blue) color components conforming to RGB color space. The M gray scale levels respectively represent the gray scale levels of R, G, and B color components. In RGB color space, the brightness and the color are mixed and cannot be separated from the R, G, and B color components. Accordingly, the apparatus of the invention is used for adjusting the gray scale levels of each pixel of each image frame in the video sequence, so as to adjust the brightness of the image frame.

In some display systems, the M color components and the M gray scale levels are converted by Gamma adjust transformation, so there is a respective linear correlation between the M gray scale levels and the brightness of the M color components.

In some display systems, besides aforementioned Gamma adjust transformation, the inputted might be amplified to provide more details in gray scale levels. For instance, an image with 8-bits may be amplified into 12-bits during Gamma adjust transformation.

In the first embodiment, the apparatus of the invention functions adjusting the M gray scale levels of the M color components of the ith image frame in the video sequence, and i is an integer index ranging from 1 to N. The gray scale levels of the image frames previous to the ith image frame have been adjusted, and each of the image frames previous to the ith image frame has a respective brightness ratio. Each brightness ratio is determined based on the gray scale levels of the corresponding image frame and is within an allowable range. A plurality of gains is previously provided. Each of the gains corresponds to one of the brightness ratios and varies within the allowable range.

Figure 2:
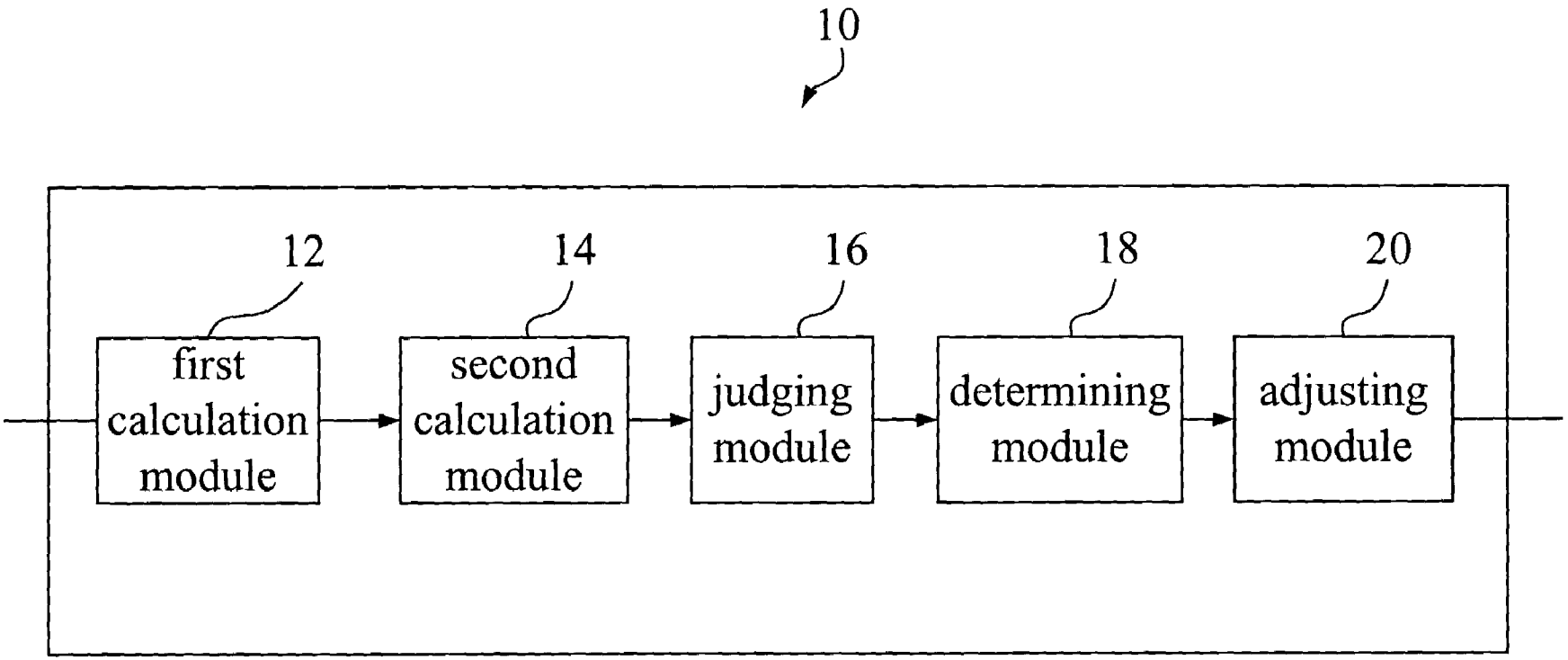
FIG. 2 is a functional block diagram illustrating the apparatus according to the first preferred embodiment of the invention.

Referring to FIG. 2, FIG. 2 is a functional block diagram illustrating the apparatus 10 according to the first preferred embodiment of the invention. The apparatus 10 for adjusting the gray scale levels includes a first calculating module 12, a second calculating module 14, a judging module 16, a determining module 18, and an adjusting module 20. The first calculating module 12 is used for retrieving all of the gray scale levels of all pixels of the ith image frame, and calculating, according to all of the gray scale levels of all pixels of the ith image frame, a current brightness ratio $BR_i$. The current brightness ratio $BR_i$ is calculated via the following equation 1:

$$BR_i = \frac{Y_i}{Y_{total}}, \qquad \text{Equation 1}$$

wherein $Y_i$ represents the sum of all of the gray scale levels of all pixels of the ith image frame, and $Y_{total}$ represents a predefined sum of all of the gray scale levels of all pixels of each image frame. For example, if an 8 bit image has T pixels, $Y_{total}$ is equal to 255*T. $Y_i$ is calculated via the following equation 2:

$$Y_i = 0.3\sum_{j=1}^{T} GR_j + 0.59\sum_{j=1}^{T} GG_j + 0.11\sum_{j=1}^{T} GB_j, \qquad \text{Equation 2}$$

wherein $GR_j$ represents the gray scale level of the R color component of the jth pixel of the ith image frame, $GG_j$ represents the gray scale level of the G color component of the jth pixel of the ith image frame, and $GB_j$ represents the gray scale level of the B color component of the jth pixel of the ith image frame, and j is an integer index ranging from 1 to T. The equation 2 conforms to Consultative Committee for International Radio (CCIR) 601 standard.

The second calculating module 14 is used for calculating, according to all of the brightness ratios of the image frames previous to the ith image frame and the current brightness ratio, an averaged brightness ratio $BR_{avg}$. The averaged brightness ratio $BR_{avg}$ is calculated via the following equation 3:

$$BR_{avg} = \frac{1}{i}\sum_{k=1}^{i} BR_k. \quad \text{Equation 3}$$

The judging module 16 is used for receiving the current brightness ratio $BR_i$ and the averaged brightness ratio $BR_{avg}$. The judging module 16 further stores a threshold. When the difference between the current brightness ratio $BR_i$ and the averaged brightness ratio $BR_{avg}$ is larger than the threshold, i.e. $|BR_i-BR_{avg}|>$Threshold, the judging module 16 outputs the current brightness ratio $BR_i$ as the outputted brightness ratio and replaces all of the brightness ratios of the image frames previous to the ith image frame by the current brightness ratio $BR_i$ of the ith image frame. When the difference between the current brightness ratio $BR_i$ and the averaged brightness ratio $BR_{avg}$ is smaller than the threshold, i.e. $|BR_i-BR_{avg}|<$Threshold, the judging module 16 outputs the averaged brightness ratio $BR_{avg}$ as the outputted brightness ratio. The outputted brightness ratio is also within the allowable range.

The determining module 18 is used for storing the brightness ratios varying within the allowable range and the corresponding gains. The determining module 18 has an input coupled to receive the outputted brightness ratio and determines the gain corresponding to the outputted brightness ratio. The adjusting module 20 is used for receiving the gain corresponding to the outputted brightness ratio and for multiplying the gray scale level of each color component of the ith image frame by the gain corresponding to the outputted brightness ratio, respectively. Accordingly, the brightness of the ith image frame in the inputted video sequence can be controlled, so as to prevent the image brightness from changing violently.

In some display systems, if the inputted video sequence had been amplified, after the brightness of the video sequence is adjusted by the apparatus of the invention, the adjusted video sequence has to be processed via an error diffusion calculation.

In some display systems, if the inputted video sequence had been converted by a first Gamma adjust transformation, after the brightness of the video sequence is adjusted by the apparatus of the invention, the adjusted video sequence has to be converted by a second Gamma adjust transformation, so as to maintain the product of the first Gamma adjust transformation and the second Gamma adjust transformation as 1.0.

Figure 3:
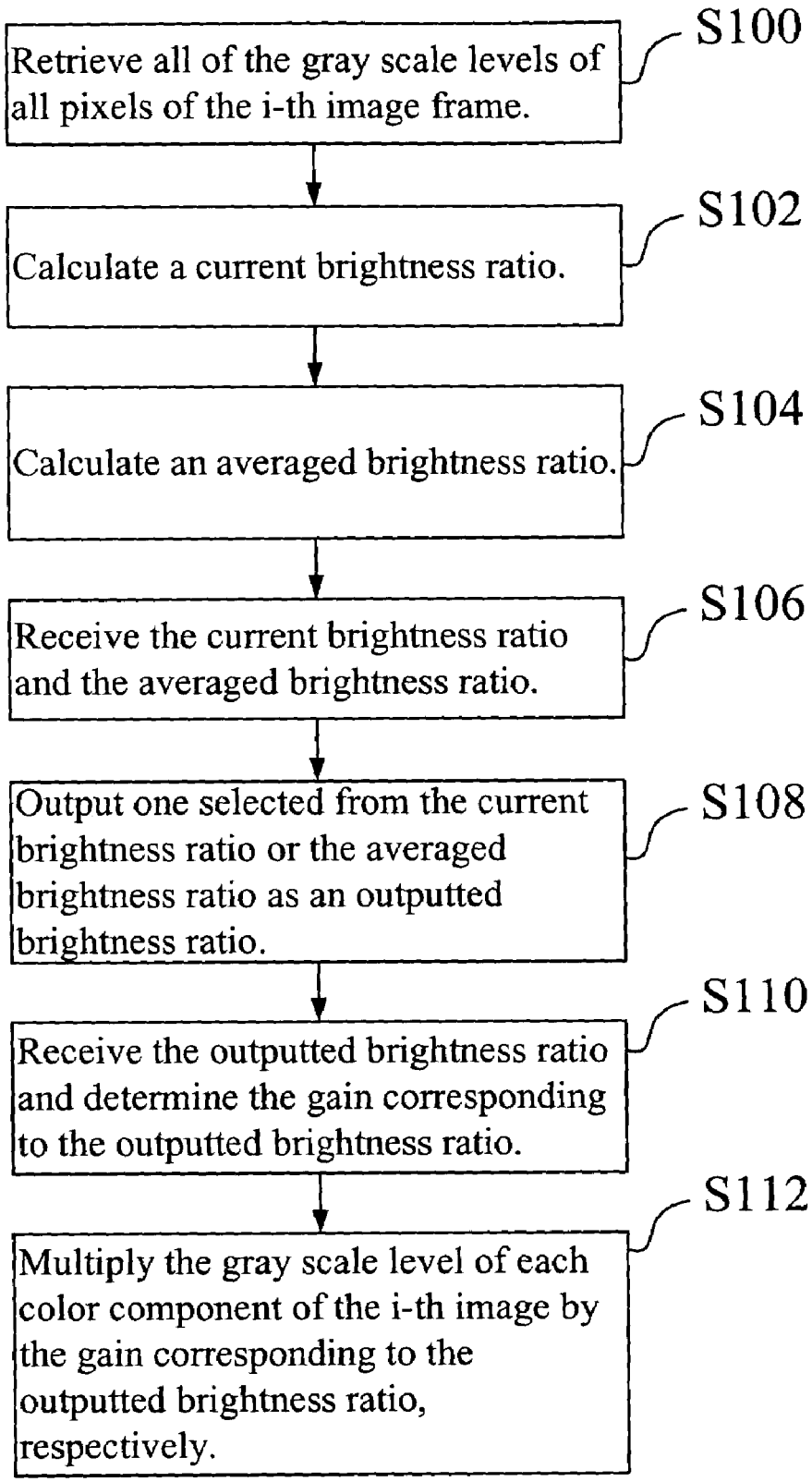
FIG. 3 is a flowchart illustrating the method according to the first preferred embodiment of the invention.

Referring to FIG. 3, FIG. 3 is a flowchart illustrating the method according to the first preferred embodiment of the invention. According to the above-mentioned first preferred embodiment, the method for adjusting the gray scale levels includes the following steps. At start, step S100 is performed to retrieve all of the gray scale levels of all pixels of the ith image frame. Afterwards, step S102 is performed. In step S102, a current brightness ratio is calculated according to all of the gray scale levels of all pixels of the ith image frame. Step 104 is then performed. In step 104, an averaged brightness ratio is calculated according to all of the brightness ratios of the image frames previous to the ith image frame and the current brightness ratio. Step 106 is then performed. In step 106, the current brightness ratio and the averaged brightness ratio both are received. Step 108 is then performed. In step 108, one selected from the current brightness ratio or the averaged brightness ratio is outputted as an outputted brightness ratio, wherein the outputted brightness ratio is also within the allowable range. Step 110 is then performed. In step 110, the brightness ratios varying within the allowable range and the corresponding gains are stored, the outputted brightness ratio is received, and the gain corresponding to the outputted brightness ratio is determined. Step 112 is then performed. In step 112, the gain corresponding to the outputted brightness ratio is received, and the gray scale level of each color component of the ith image is multiplied by the gain corresponding to the outputted brightness ratio, respectively.

Figure 4:
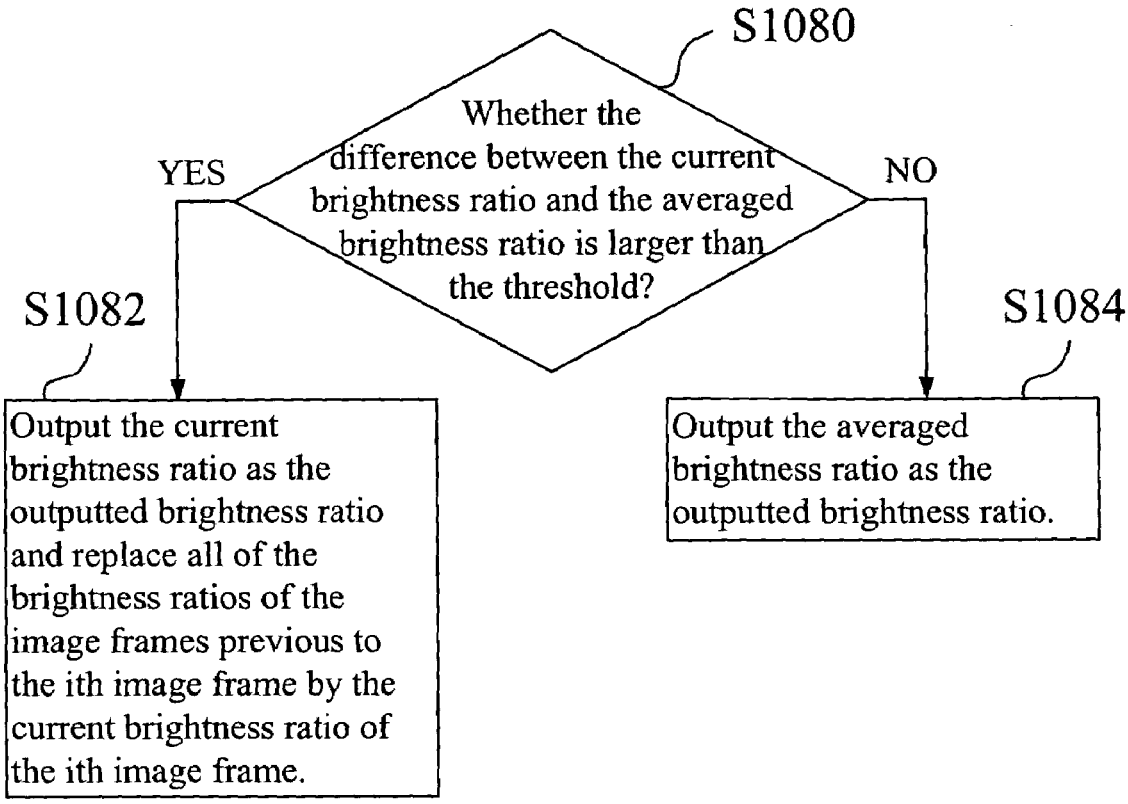
FIG. 4 is a flowchart illustrating the step S108 shown in FIG. 3 in detail.

Referring to FIG. 4, FIG. 4 is a flowchart illustrating the step S108 shown in FIG. 3 in detail. The step S108 further includes the following steps. Step S1080 is performed. In step S1080, whether the difference between the current brightness ratio and the averaged brightness ratio is larger than the threshold is judged. If YES in step S1080, step S1082 is then performed. In step S1082, the current brightness ratio is outputted as the outputted brightness ratio and all of the brightness ratios of the image frames previous to the ith image frame are replaced by the current brightness ratio of the ith image frame. If NO in step S1080, step S1084 is then performed. In step S1084, the averaged brightness ratio is outputted as the outputted brightness ratio.

According to a second preferred embodiment of the invention, a video sequence is inputted into a display system. The inputted video sequence includes N image frames to be displayed. Each of the N image frames consists of T pixels, and each pixel of each image frame is converted to include M color components and a luminance component, and N, T, and M are respectively a natural number. In this embodiment, the inputted video sequence is converted from RGB color space to L*a*b* color space. The M color components are respectively a* and b*, and the luminance component is L*. L*a*b* color space is a standard set by Commission International d'Eclairage (CIE). In L*a*b* color space, the luminance (L*) is independent to the color (a*, b*). Accordingly, the apparatus of the invention is used for adjusting the luminance of each pixel of each image frame in the video sequence, so as to adjust the luminance of the image frame.

In some display systems, the inputted video sequence had been converted by Gamma adjust transformation to obtain the correct image brightness information.

In some display systems, besides aforementioned Gamma adjust transformation, the inputted might be amplified to provide more details in gray scale levels. For instance, an image with 8-bits may be amplified into 12-bits during Gamma adjust transformation.

In the second embodiment, the apparatus of the invention functions adjusting the luminance of the luminance components L* of the ith image frame in the video sequence, and i is an integer index ranging from 1 to N. The luminance of the image frames previous to the ith image frame has been adjusted, and each of the image frames previous to the ith image frame has a respective luminance ratio. Each luminance ratio is determined based on the luminance of the corresponding image frame and is within an allowable range. A plurality of gains is previously provided. Each of the gains corresponds to one of the luminance ratios and varies within the allowable range.

Figure 5:
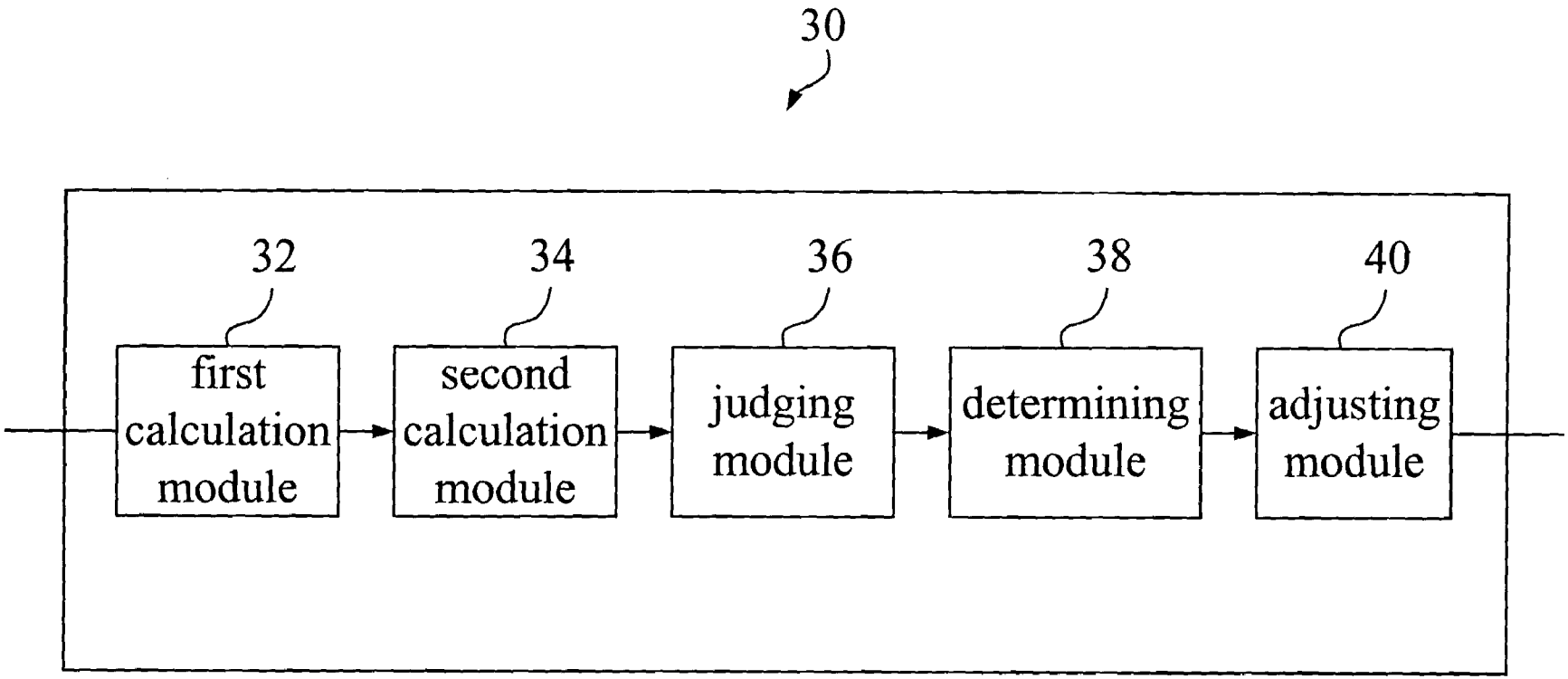
FIG. 5 is a functional block diagram illustrating the apparatus according to the second preferred embodiment of the invention.

Referring to FIG. 5, FIG. 5 is a functional block diagram illustrating the apparatus 30 according to the second preferred embodiment of the invention. The apparatus 30 for adjusting the luminance includes a first calculating module 32, a second calculating module 34, a judging module 36, a determining module 38, and an adjusting module 40. The first calculating module 32 is used for retrieving all of the luminance of all pixels of the ith image frame, and calculating, according to all of the luminance of all pixels of the ith image frame, a current luminance ratio $LR_i$. The current luminance ratio $LR_i$ is calculated via the following equation 4:

$$LR_i = \frac{L_i}{L_{total}}, \quad \text{Equation 4}$$

wherein $L_i$ represents the sum of all of the luminance of all pixels of the ith image frame, and $L_{total}$ represents a predefined sum of all of the luminance of all pixels of each image frame. For example, if an 8 bit image has T pixels, $L_{total}$ is equal to 255*T.

The second calculating module 34 is used for calculating, according to all of the luminance ratios of the image frames previous to the ith image frame and the current luminance ratio, an averaged luminance ratio $LR_{avg}$. The averaged luminance ratio $LR_{avg}$ is calculated via the following equation 5:

$$LR_{avg} = \frac{1}{i}\sum_{k=1}^{i} LR_k. \quad \text{Equation 5}$$

The judging module 36 is used for receiving the current luminance ratio $LR_i$ and the averaged luminance ratio $LR_{avg}$. The judging module 36 further stores a threshold. When the difference between the current luminance ratio $LR_i$ and the averaged luminance ratio $LR_{avg}$ is larger than the threshold, i.e. $|LR_i - LR_{avg}| > \text{Threshold}$, the judging module 36 outputs the current luminance ratio $LR_i$ as the outputted luminance ratio and replaces all of the luminance ratios of the image frames previous to the ith image frame by the current luminance ratio $LR_i$ of the ith image frame. When the difference between the current luminance ratio $LR_i$ and the averaged luminance ratio $LR_{avg}$ is smaller than the threshold, i.e. $|LR_i - LR_{avg}| < \text{Threshold}$, the judging module 36 outputs the averaged luminance ratio $LR_{avg}$ as the outputted luminance ratio. The outputted luminance ratio is also within the allowable range.

The determining module 38 is used for storing the luminance ratios varying within the allowable range and the corresponding gains. The determining module 38 has an input coupled to receive the outputted luminance ratio and determines the gain corresponding to the outputted luminance ratio. The adjusting module 40 is used for receiving the gain corresponding to the outputted luminance ratio and for multiplying the luminance of each luminance component of the ith image frame by the gain corresponding to the outputted luminance ratio, respectively. Accordingly, the luminance of the ith image frame in the inputted video sequence can be controlled, so as to prevent the image luminance from changing violently.

In some display systems, if the inputted video sequence had been amplified, after the luminance of the video sequence is adjusted by the apparatus of the invention, the adjusted video sequence has to be processed via an error diffusion calculation.

In the second embodiment, because the current display system can only receive RGB signals, when the luminance of the video sequence has been adjusted, the adjusted video sequence has to be converted from L*a*b* color space to RGB color space.

In some display systems, if the inputted video sequence had been converted by a first Gamma adjust transformation, after the luminance of the video sequence is adjusted by the apparatus of the invention, the adjusted video sequence has to be converted by a second Gamma adjust transformation, so as to maintain the product of the first Gamma adjust transformation and the second Gamma adjust transformation as 1.0.

Figure 6:
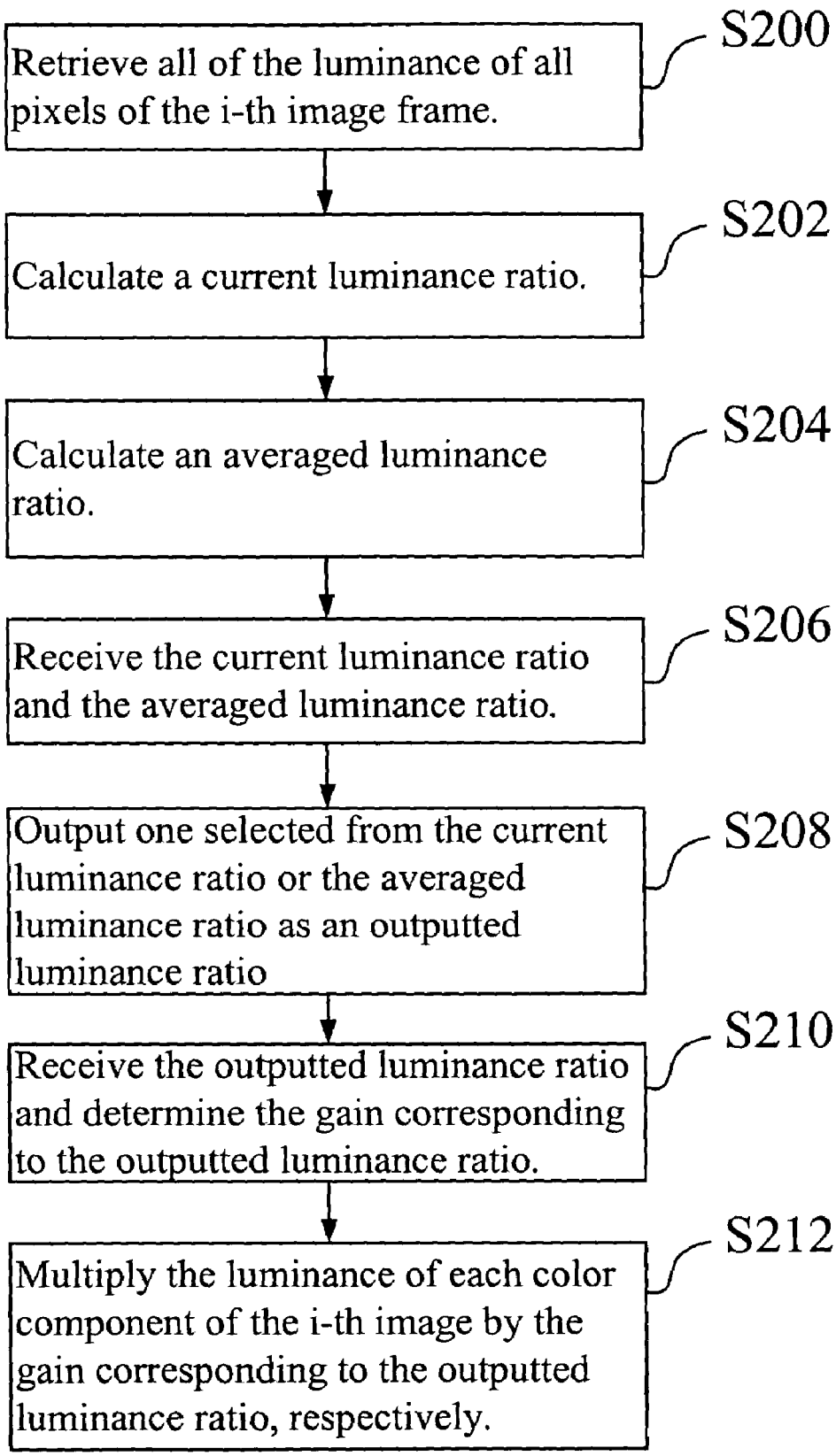
FIG. 6 is a flowchart illustrating the method according to the second preferred embodiment of the invention.

Referring to FIG. 6, FIG. 6 is a flowchart illustrating the method according to the second preferred embodiment of the invention. According to the above-mentioned second preferred embodiment, the method for adjusting the luminance includes the following steps. At start, step S200 is performed to retrieve all of the luminance of all pixels of the ith image frame. Afterwards, step S202 is performed. In step S202, a current luminance ratio is calculated according to all of the luminance of all pixels of the ith image frame. Step 204 is then performed. In step 204, an averaged luminance ratio is calculated according to all of the luminance ratios of the image frames previous to the ith image frame and the current luminance ratio. Step 206 is then performed. In step 206, the current luminance ratio and the averaged luminance ratio both are received. Step 208 is then performed. In step 208, one selected from the current luminance ratio or the averaged luminance ratio is outputted as an outputted luminance ratio, wherein the outputted luminance ratio is also within the allowable range. Step 210 is then performed. In step 210, the luminance ratios varying within the allowable range and the corresponding gains are stored, the outputted luminance ratio is received, and the gain corresponding to the outputted luminance ratio is determined. Step 212 is then performed. In step 212, the gain corresponding to the outputted luminance ratio is received, and the luminance of each color component of the ith image is multiplied by the gain corresponding to the outputted luminance ratio, respectively.

Figure 7:
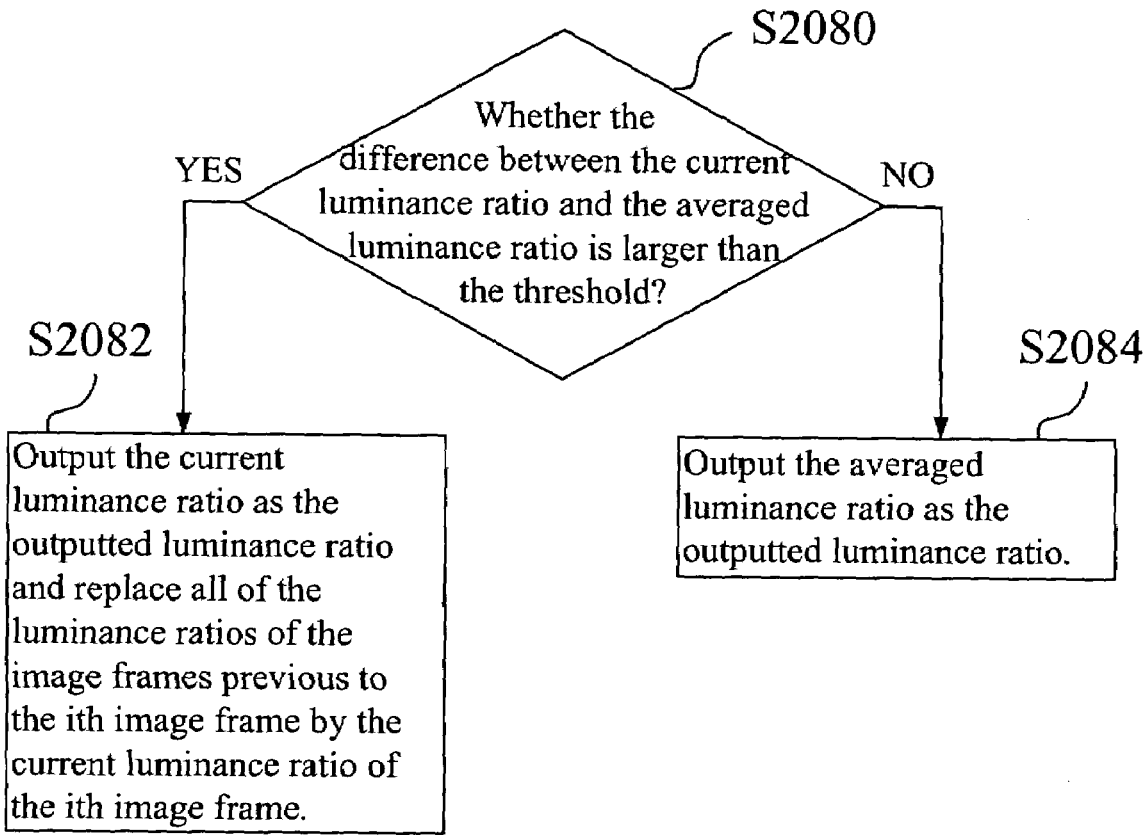
FIG. 7 is a flowchart illustrating the step S208 shown in FIG. 6 in detail.

Referring to FIG. 7, FIG. 7 is a flowchart illustrating the step S208 shown in FIG. 6 in detail. The step S208 further includes the following steps. Step S2080 is performed. In step S2080, whether the difference between the current luminance ratio and the averaged luminance ratio is larger than the threshold is judged. If YES in step S2080, step S2082 is then performed. In step S2082, the current luminance ratio is outputted as the outputted luminance ratio and all of the luminance ratios of the image frames previous to the ith image frame are replaced by the current luminance ratio of the ith image frame. If NO in step S2080, step S2084 is then performed. In step S2084, the averaged luminance ratio is outputted as the outputted luminance ratio.

Figure 8:
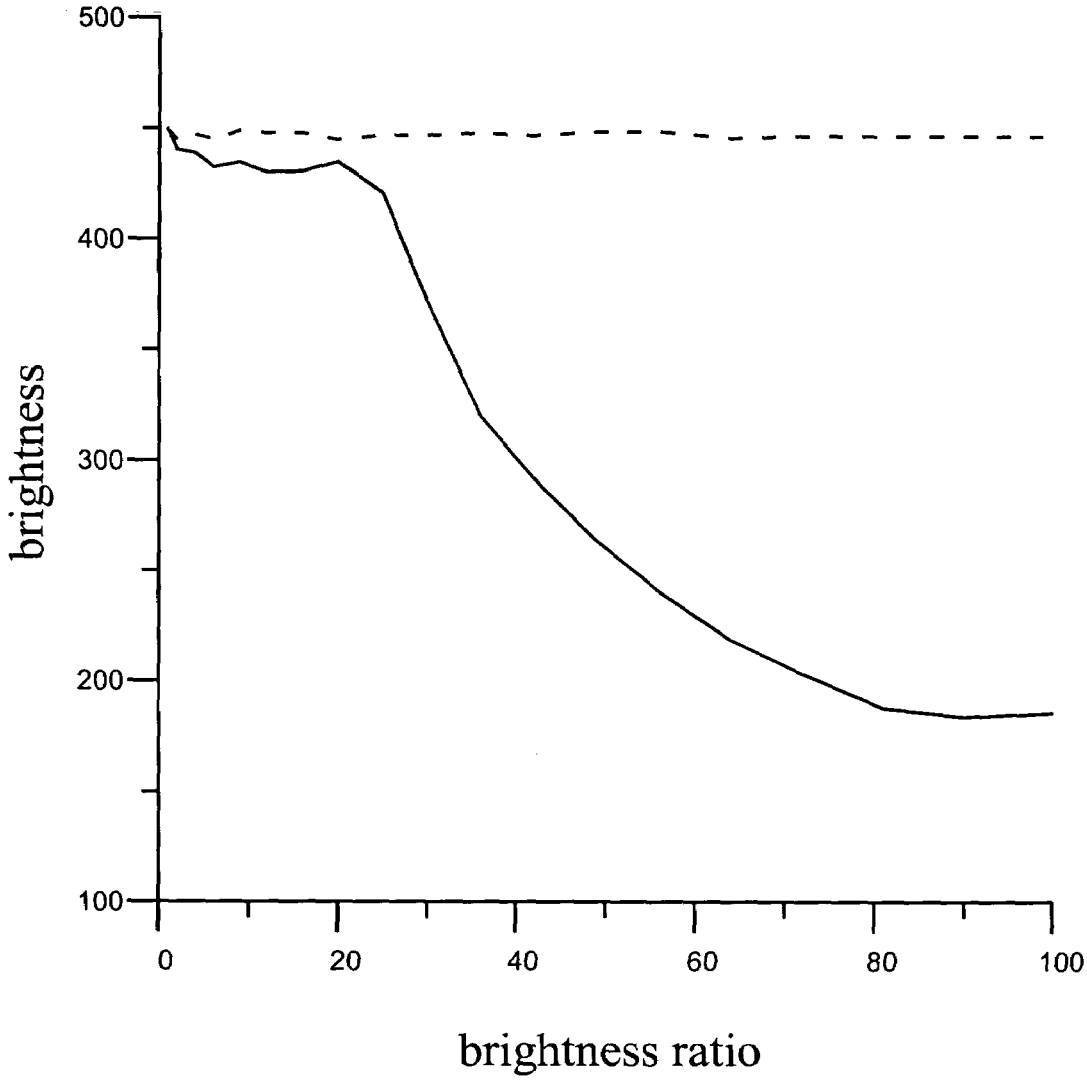
FIG. 8 is a diagram illustrating the relation between the brightness and the brightness ratio after an LCD TV is adjusted by the invention.

Referring to FIG. 8, FIG. 8 is a diagram illustrating the relation between the brightness and the brightness ratio after an LCD TV is adjusted by the invention. As shown in FIG. 8, the dotted line represents that the brightness of the LCD TV has not been adjusted yet, and the solid line represents that the brightness of the LCD TV has been adjusted. Obviously, the brightness curve of the LCD TV is close to the brightness curve of the CRT TV shown in FIG. 1A when the brightness of the LCD TV has been adjusted by the invention.

Compared to the prior art, when the display system displays a program, the apparatus of the invention can prevent the image brightness from changing violently, so as to reduce the load for the eye when a user watches the program for a long time and to improve the contrast of the image. Moreover, the apparatus of the invention is suitable for all kinds of color spaces.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. In a display system, an inputted video sequence comprising N image frames to be displayed which each consists of T pixels, each pixel of each image frame comprising M color components and M gray scale levels which each corresponds to one of the M color components, N, T, and M being a natural number, respectively, an apparatus functioning adjusting the M gray scale levels of the M color components of the ith image frame in the video sequence, i being an integer index ranging from 1 to N, the gray scale levels of the image frames previous to the ith image frame having been adjusted, each of the image frames previous to the ith image frame having a respective brightness ratio which relates to the gray scale levels been determined of said one image frame and is within an allowable range, a plurality of gains which each corresponds to one of the brightness ratios varying within the allowable range being previously provided, said apparatus comprising:

a first calculating module for retrieving all of the gray scale levels of all pixels of the ith image frame, and calculating, according to all of the gray scale levels of all pixels of the ith image frame, a current brightness ratio;

a second calculating module for calculating, according to all of the brightness ratios of the image frames previous to the ith image frame and the current brightness ratio, an averaged brightness ratio;

a judging module for receiving the current brightness ratio and the averaged brightness ratio, and judging whether the difference between the current brightness ratio and the averaged brightness ratio is larger than a threshold, and then the judging module outputting one selected from the current brightness ratio or the averaged brightness ratio as an outputted brightness ratio according to the judging result of the judging module, wherein the outputted brightness ratio is also within the allowable range;

a determining module for storing the brightness ratios varying within the allowable range and the corresponding gains, the determining module having an input coupled to receive the outputted brightness ratio, the determining module also functioning determining the gain corresponding to the outputted brightness ratio; and an adjusting module for receiving the gain corresponding to the outputted brightness ratio, and multiplying the gray scale level of each color component of the ith image frame by the gain corresponding to the outputted brightness ratio, respectively.

2. The apparatus of claim 1, wherein the M color components are R, G, and B (Red, Green, and Blue) color components respectively conforming to RGB color space.

3. The apparatus of claim 2, wherein the current brightness ratio $BR_i$ is calculated by the first calculating module via the following equation:

$$BR_i = \frac{Y_i}{Y_{total}};$$

wherein $Y_i$ represents the sum of all of the gray scale levels of all pixels of the ith image frame, and $Y_{total}$ represents a predefined sum of all of the gray scale levels of all pixels of each image frame.

4. The apparatus of claim 3, wherein the sum of all of the gray scale levels of all pixels of the ith image frame $Y_i$ is calculated via the following equation:

$$Y_i = 0.3\sum_{j=1}^{L} GR_j + 0.59\sum_{j=1}^{L} GG_j + 0.11\sum_{j=1}^{L} GB_j$$

wherein $GR_j$ represents the gray scale level of the R color component of the jth pixel of the ith image frame, $GG_j$ represents the gray scale level of the G color component of the jth pixel of the ith image frame, and $GB_j$ represents the gray scale level of the B color component of the jth pixel of the ith image frame, and j is an integer index ranging from 1 to T.

5. The apparatus of claim 4, wherein the averaged brightness ratio $BR_{avg}$ is calculated by the second calculating module via the following equation:

$$BR_{avg} = \frac{1}{i}\sum_{k=1}^{i} BR_k.$$

6. The apparatus of claim 5, wherein the threshold is stored in the judging module, when the difference between the current brightness ratio and the averaged brightness ratio is larger than the threshold, the judging module outputs the current brightness ratio as the outputted brightness ratio and replaces all of the brightness ratios of the image frames previous to the ith image frame by the current brightness ratio of the ith image frame, and when the difference between the current brightness ratio and the averaged brightness ratio is smaller than the threshold, the judging module outputs the averaged brightness ratio as the outputted brightness ratio.

7. In a display system, an inputted video sequence comprising N image frames to be displayed which each consists of T pixels, each pixel of each image frame comprising M color components and M gray scale levels which each corresponds to one of the M color components, N, T, and M being a natural number, respectively, a method functioning adjusting the M gray scale levels of the M color components of the ith image frame in the video sequence, i being an integer index ranging from 1 to N, the gray scale levels of the image frames previous to the ith image frame having been adjusted, each of the image frames previous to the ith image frame having a respective brightness ratio which relates to the gray scale levels been determined of said one image frame and is within an allowable range, a plurality of gains which each corresponds to one of the brightness ratios varying within the allowable range being previously provided, said method comprising the following steps of:

(a) retrieving all of the gray scale levels of all pixels of the ith image frame;

(b) calculating a current brightness ratio according to all of the gray scale levels of all pixels of the ith image frame;

(c) calculating an averaged brightness ratio according to all of the brightness ratios of the image frames previous to the ith image frame and the current brightness ratio;

(d) receiving the current brightness ratio and the averaged brightness ratio;

(e) judging whether the difference between the current brightness ratio and the averaged brightness ratio is larger than a threshold and outputting one selected from the current brightness ratio or the averaged brightness ratio as an outputted brightness ratio according to the judging result, wherein the outputted brightness ratio is also within the allowable range;

(f) storing the brightness ratios varying within the allowable range and the corresponding gains, receiving the outputted brightness ratio, and determining the gain corresponding to the outputted brightness ratio; and (g) receiving the gain corresponding to the outputted brightness ratio, and multiplying the gray scale level of each color component of the ith image by the gain corresponding to the outputted brightness ratio, respectively.

8. The method of claim 7, wherein the M color components are R, G, and B (Red, Green, and Blue) color components respectively conforming to RGB color space.

9. The method of claim 8, wherein the current brightness ratio $BR_i$ is calculated by the first calculating module via the following equation:

$$BR_i = \frac{Y_i}{Y_{total}};$$

wherein $Y_i$ represents the sum of all of the gray scale levels of all pixels of the ith image frame, and $Y_{total}$ represents a predefined sum of all of the gray scale levels of all pixels of each image frame.

10. The method of claim 9, wherein the sum of all of the gray scale levels of all pixels of the ith image frame $Y_i$ is calculated via the following equation:

$$Y_i = 0.3\sum_{j=1}^{L} GR_j + 0.59\sum_{j=1}^{L} GG_j + 0.11\sum_{j=1}^{L} GB_j$$

wherein $GR_j$ represents the gray scale level of the R color component of the jth pixel of the ith image frame, $GG_j$ represents the gray scale level of the G color component of the jth pixel of the ith image frame, and $GB_j$ represents the gray scale level of the B color component of the jth pixel of the ith image frame, and j is an integer index ranging from 1 to T.

11. The method of claim 10, wherein the averaged brightness ratio $BR_{avg}$ is calculated by the second calculating module via the following equation:

$$BR_{avg} = \frac{1}{i}\sum_{k=1}^{i} BR_k.$$

12. The method of claim 11, wherein the step (e) further comprises the following steps of:

(e1) judging whether the difference between the current brightness ratio and the averaged brightness ratio is larger than the threshold;

(e2) if YES in step (e1), outputting the current brightness ratio as the outputted brightness ratio and replacing all of the brightness ratios of the image frames previous to the ith image frame by the current brightness ratio of the ith image frame; and (e3) if NO in step (e1), outputting the averaged brightness ratio as the outputted brightness ratio.

13. In a display system, an inputted video sequence comprising N image frames to be displayed which each consists of T pixels, each pixel of each image frame being converted to comprise M color components and a luminance component, N, T, and M being a natural number, respectively, an apparatus functioning adjusting the luminance of the luminance component of the ith image frame in the video sequence, i being an integer index ranging from 1 to N, the luminance of the image frames previous to the ith image frame having been adjusted, each of the image frames previous to the ith image frame having a respective luminance ratio which relates to the luminance been determined of said one image frame and is within an allowable range, a plurality of gains which each corresponds to one of the luminance ratios varying within the allowable range being previously provided, said apparatus comprising:

a first calculating module for retrieving all of the luminance of all pixels of the ith image frame, and calculating, according to all of the luminance of all pixels of the ith image frame, a current luminance ratio;

a second calculating module for calculating, according to all of the luminance ratios of the image frames previous to the ith image frame and the current luminance ratio, an averaged luminance ratio;

a judging module for receiving the current luminance ratio and the averaged luminance ratio, and judging whether the difference between the current luminance ratio and the averaged luminance ratio is larger than a threshold, and then the judging module outputting one selected from the current luminance ratio or the averaged luminance ratio as an outputted luminance ratio according to the judging result of the judging module, wherein the outputted luminance ratio is also within the allowable range;

a determining module for storing the luminance ratios varying within the allowable range and the corresponding gains, the determining module having an input coupled to receive the outputted luminance ratio, the determining module also functioning determining the gain corresponding to the outputted luminance ratio; and an adjusting module for receiving the gain corresponding to the outputted luminance ratio, and multiplying the luminance of each luminance component of the ith image by the gain corresponding to the outputted luminance ratio, respectively.

14. The apparatus of claim 13, wherein the M color components and the luminance component conform to L*a*b* color space.

15. The apparatus of claim 14, wherein the current luminance ratio $LR_i$ is calculated by the first calculating module via the following equation:

$$LR_i = \frac{L_i}{L_{total}};$$

wherein $L_i$ represents the sum of all of the luminance of all pixels of the ith image frame, and $L_{total}$ represents a predefined sum of all of the luminance of all pixels of each image frame.

16. The apparatus of claim 15, wherein the averaged luminance ratio $LR_{avg}$ is calculated by the second calculating module via the following equation:

$$LR_{avg} = \frac{1}{i}\sum_{k=1}^{i} LR_k.$$

17. The apparatus of claim 16, wherein the threshold is stored in the judging module, when the difference between the current luminance ratio and the averaged luminance ratio is larger than the threshold, the judging module outputs the current luminance ratio as the outputted luminance ratio and replaces all of the luminance ratios of the image frames previous to the ith image frame by the current luminance ratio of the ith image frame, and when the difference between the current luminance ratio and the averaged luminance ratio is smaller than the threshold, the judging module outputs the averaged luminance ratio as the outputted luminance ratio.

18. In a display system, an inputted video sequence comprising N image frames to be displayed which each consists of T pixels, each pixel of each image frame being converted to comprise M color components and a luminance component, N, T, and M being a natural number, respectively, a method functioning adjusting the luminance of the luminance component of the ith image frame in the video sequence, i being an integer index ranging from 1 to N, the luminance of the image frames previous to the ith image frame having been adjusted, each of the image frames previous to the ith image frame having a respective luminance ratio which relates to the luminance been determined of said one image frame and is within an allowable range, a plurality of gains which each corresponds to one of the luminance ratios varying within the allowable range being previously provided, said method comprising the steps of:

(a) retrieving all of the luminance of all pixels of the ith image frame;

(b) calculating a current luminance ratio according to all of the luminance of all pixels of the ith image frame;

(c) calculating an averaged luminance ratio according to all of the luminance ratios of the image frames previous to the ith image frame and the current luminance ratio;

(d) receiving the current luminance ratio and the averaged luminance ratio;

(e) judging whether the difference between the current luminance ratio and the averaged luminance ratio is larger than a threshold and outputting one selected from the current luminance ratio or the averaged luminance ratio as an outputted luminance ratio according to the judging result, wherein the outputted luminance ratio is also within the allowable range;

(f) storing the luminance ratios varying within the allowable range and the corresponding gains, receiving the outputted luminance ratio, and determining the gain corresponding to the outputted luminance ratio; and (g) receiving the gain corresponding to the outputted luminance ratio, and multiplying the luminance of each luminance component of the ith image by the gain corresponding to the outputted luminance ratio, respectively.

19. The method of claim 18, wherein the M color components and the luminance component conform to L*a*b* color space.

20. The apparatus of claim 19, wherein the current luminance ratio $LR_i$ is calculated by the first calculating module via the following equation:

$$LR_i = \frac{L_i}{L_{total}};$$

wherein $L_i$ represents the sum of all of the luminance of all pixels of the ith image frame, and $L_{total}$ represents a predefined sum of all of the luminance of all pixels of each image frame.

21. The apparatus of claim 20, wherein the averaged luminance ratio $LR_{avg}$ is calculated by the second calculating module via the following equation:

$$LR_{avg} = \frac{1}{i}\sum_{k=1}^{i} LR_k.$$

22. The apparatus of claim 21, wherein the step (e) further comprises the following steps of:

(e1) judging whether the difference between the current luminance ratio and the averaged luminance ratio is larger than the threshold;

(e2) if YES in step (e1), outputting the current luminance ratio as the outputted luminance ratio and replacing all of the luminance ratios of the image frames previous to the ith image frame by the current luminance ratio of the ith image frame; and (e3) if NO in step (e1), outputting the averaged luminance ratio as the outputted luminance ratio.

* * * * *